United States Patent [19]

Hall

[11] Patent Number: 4,779,722

[45] Date of Patent: Oct. 25, 1988

[54] MATERIAL MIXING CONTAINER

[76] Inventor: John E. Hall, 9900 Camino Royal - Apt. 91, Merriam, Kans. 66203

[21] Appl. No.: 90,757

[22] Filed: Aug. 28, 1987

[51] Int. Cl.[4] ..... B65D 23/04

[52] U.S. Cl. ..... 206/221; 206/219; 206/459; 215/DIG. 8

[58] Field of Search ..... 206/219, 221; 215/DIG. 8

[56] References Cited

U.S. PATENT DOCUMENTS

| | | | |
|---|---|---|---|
| 3,239,089 | 3/1966 | Moylan | 206/221 |
| 3,410,444 | 11/1968 | Morane | 206/221 X |
| 3,825,410 | 7/1974 | Bagshawe | 206/221 X |
| 4,175,658 | 11/1979 | Moser et al. | 206/221 |

*Primary Examiner*—William Price

*Attorney, Agent, or Firm*—John A. Hamilton

[57] ABSTRACT

A container adapted to contain a number of ingredients separated until intermixture thereof is desired, consisting of a bottle having a plurality of sections each adapted to carry one of the ingredients, successive pairs of sections being separated by partitions each carrying a normally closed valve which when opened establishes communication between the associated bottle sections. The valves are individually operable manually, so that if three or more materials are to be intermixed, the order of intermixture may be controlled, and also may be closely regulated as to the degree of opening, whereby to control the rate on intermixture. A lock is also provided to prevent accidental opening of any of the valves until intermixture is desired.

10 Claims, 1 Drawing Sheet

MATERIAL MIXING CONTAINER

This invention relates to new and useful improvements in containers and has particular reference to containers adapted to mix a plurality of ingredients together, which were previously held separately in individual compartments, just prior to actual use.

BACKGROUND OF THE INVENTION

Certain products consist of a plurality of ingredients, usually either liquid or powder, which advantageously should be mixed together just prior to actual use, but the ingredients of which should, for convenience of use, be furnished and sold in a single package or container. The present invention is especially adapted for use with two or three ingredients or substances which have extended shelf life when not mixed, but which must be used relatively soon after mixture to prevent deterioration. One example, in the pharmaceutical field, are certain types of local anesthetics, ingredients of which, if mixed just prior to actual administration to the patient, provide the advantages of faster onset of the anesthetic effect, a deeper anesthetic effect, and longer duration of the anesthetic effect. One such anesthetic is Lidocaine, which should be mixed with a buffering agent, such as $NaHCO_3$ just prior to administration. There are many examples of this need in the pharmaceutical field. A number of injectable medicaments are stable for only short periods of time once they are in solution, such as when a dry ingredient is mixed with a diluent solution. There are many examples of this need in fields other than pharmaceutical, such as in the case of epoxy adhesives, cleansing solutions, various cosmetics and hair dyes. Conventional hair dyes, for example, employ a peroxide solution or the like, with which one or more pigmented solutions are mixed for immediate application to the hair, the color being determined by the make-up of the pigmented solutions. The provision of a container compartmented to contain each of the ingredients in its own compartment, but permitting intermixture of the ingredients whenever desired would obviously be useful and advantageous.

Certain prior art has made steps in this direction. Perhaps most notably, necked bottles have been provided with a plunger disposed slidably in the neck to seal it, and a stopper sealed in a restriction of the bottle disposed intermedite its ends. Different ingredients may thus be stored in the bottle compartments respectively above and below the stopper, and when it is desired to use the mixed ingredients, the stopper may be dislodged by pressing inwardly on the plunger, which exerts hydrostatic force through the liquid in the top compartment to dislodge the stopper into the bottom compartment. This concept has the disadvantage that it requires the top compartment to be substantially full, in order that the plunger may exert the necessary hydrostatic force to dislodge the stopper. This in turn limits the flexibility of application of the device, requiring compartments, particularly top comparnents, carefully designed to contain only the amount of liquid required for an individual dosage, in the case of pharmaceuiical products, or for a single usage in other fields of application. In the pharmaceutical field alone, this would require the manufacture and stocking of container bottles of an extremely large number of different sizes. Also, since it is virtually impossible to retrieve the dislodged stopper from the lower section of the bottle, the device is almost necessarily a single-use device, not capable of refilling and reuse. Another class of prior art utilizes compartmented bottles with the compartments divided from each other by diaphragms capable of being ruptured, and means such as plungers or the like for mechanically rupturing said diaphragms. Such devices are also single-use, non-reusable devices, and together with devices of the previously mentioned stopper type, do not allow control of the rate of intermixture of the ingredients, nor permit control of the order of intermixture if there are more than two ingredients to be mixed. Both of the latter named capabilities are important under many circumstances.

SUMMARY OF THE INVENTION

Accordingly, the primary object of the present invention is the provision of a mixing container consisting of a bottle or other container having a plurality of compartments normally sealed from each other, a valve interposed between each adjacent pair of compartments, and means operable from externally of the container to open said valves to permit intermixture of the contents of the compartments whenever desired.

Another object is the provision of a mixing container of the character described in which the valves separating adjacent compartments may be opened in any desired order, whereby when there are three or more ingredients to be mixed, they may be mixed in any desired order, as is desirable under certain circumstances.

A further object is the provision of a mixing container of the character described in which said valves may be opened to any desired degree, whereby the rate or speed of intermixture may be adjusted, as is desirable under certain circumstances.

A still further object is the provision of a mixing container of the character described in which the container has the form of a bottle having a plurality of coaxial but axially offset sections, adjacent sections having planar end walls overlying each other normally of the bottle axis, said end walls having holes formed therethrough, the holes of the respective end walls normally being out of registry to seal off any communication between the sections, but being capable of being brought into registry, whereby to establish communication between the sections, by relative rotation of the bottle sections about the bottle axis.

Still another object is the provision of a mixing container of the character described having means assembling each successive pair of bottle sections together, but permitting relative rotation thereof, and also urging said sections axially together with sufficient force to provide sealing contact between the end walls of the corresponding bottle sections and a compressible sealing disc interposed between said end walls.

Another object is the provision of a mixing container of the character described having means releasably locking each pair of adjacent bottle sections against relative rotation, whereby accidental or untimely intermixture of the ingredients is prevented.

Other objects are simplicity and economy of structure, and efficiency and dependability of operation.

BRIEF DESCRIPTION OF THE DRAWING

With the above objects in view, as well as other objects which will appear in the course of the specification, reference will be had to the accompanying drawing, wherein.

DESCRIPTION OF PREFERRED EMBODIMENTS

Figure 3:
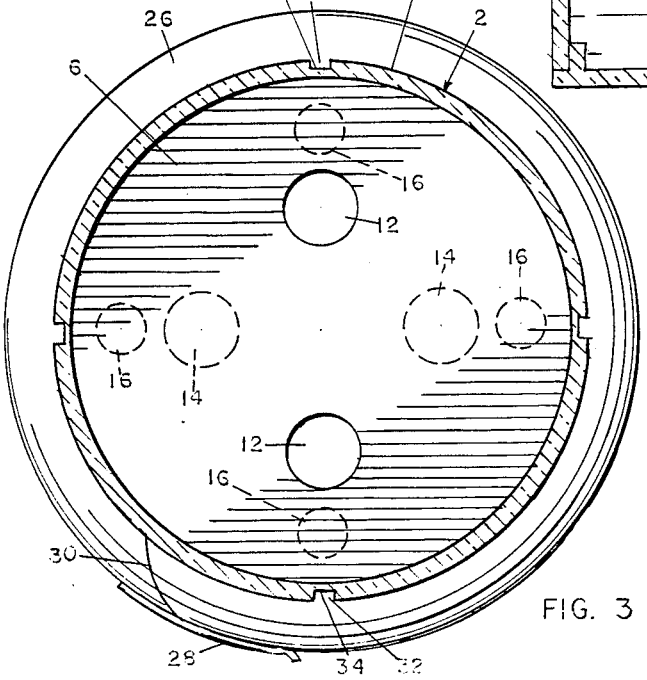
FIG. 3 is a sectional view taken on line III—III of FIG. 2.

Like reference numerals apply to similar parts throughout the several views. In the illustrated form, the container has the form of a cylindrical bottle indicated generally by the numeral 2. Said bottle is formed of glass, plastic or any other suitable material, and is divided transversely of its axis into three sections 2A, 2B and 2C. Top section 2A is provided with a neck 4 capable of receiving a closure to be described hereinbelow. Each of the three sections 2A, 2B and 2C is provided at its lower end with a planar bottom wall 6 disposed accurately at right angles to the axis of the bottle. Bottom walls 6 are shown as inserts each sealed into its associated bottle section, in the interests of easier manufacture. Each of sections 2B and 2C is provided at its upper end with an integral top wall 8, which is also at right angles to the bottle axis, and is parallel and closely adjacent the bottom wall 6 of the next higher bottle section. A sealing disc 10 formed of soft rubber or other resiliently compressible material is disposed between the bottom wall 6 of the higher bottle section and the top wall 8 of the lower bottle section. A pair of angularly spaced holes 12 are formed in the bottom wall 6 of sections 2A and 2B, and a pair of holes 14 are similarly formed through top wall 8 of sections 2B and 2C, and through sealing disc 10. The sealing disc is furnished with downward projections 16 which engage in matching sockets formed in the associated top walls 8, in order to insure that the holes 14 the sealing disc and top walls 8 are always in registry. Holes 12 and 14 are not normally in registry, however, as shown in FIG. 3, which represents the position of the parts in the shipping, handling and storage of the container, but are ninety degrees out of registry. In this position, all communication between the adjacent bottle sections is sealed off. By turning the adjacent bottle sections relatively ninety degrees about the bottle axis, with the bottom surface of end wall 6 moving in a rotary sliding movement against the top surface of sealing disc 10, holes 12 and 14 may be brought into registry, as shown in FIG. 4, and communication between the two adjacent bottle sections is established.

Each of bottle sections 2A and 2B is provided at its lower end with an external, outwardly projecting, rounded peripheral rib 18, and each of bottle sections 2B and 2C is provided at its upper end with a similar external, outwardly projecting, rounded peripheral rib 20. Each adjacent pair of bottle sections is assembled together, in the form of the invention shown in FIGS. 1 and 2, by means of a snap ring 22, formed of a tough but elastic material such as certain plastics. Each of said snap rings is of such a diameter that it must be peripherally stretched to pass around the bottle, and is provided on its inner surface with a pair of parallel grooves adapted to snap respectively over a corresponding pair of the ribs 18 and 20 when the corresponding pair of bottle sections are forced axially together. Said bottle sections are thus firmly assembled together, but may be turned rotatably relative to each other about the bottle axis. The inner surface of the snap ring, at its upper and lower edges, is bevelled as indicated at 24 to facilitate the entry of ribs 18 and 20 into the grooves of the snap ring as the parts are assembled. The spacing of the rib grooves of the snap ring is sufficiently small to provide compression of the sealing disc, whereby to insure an efficient seal between said sealing disc and the mating surfaces of the bottle section end walls which engage it.

Figure 5:
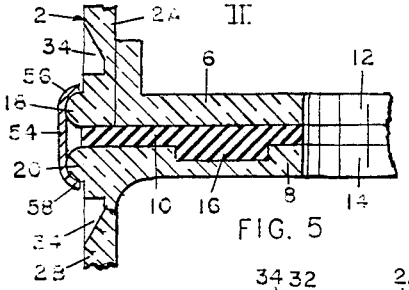
FIG. 5 is a view similar to FIG. 4, but showing a still further modified assembly means.
Figure 4:
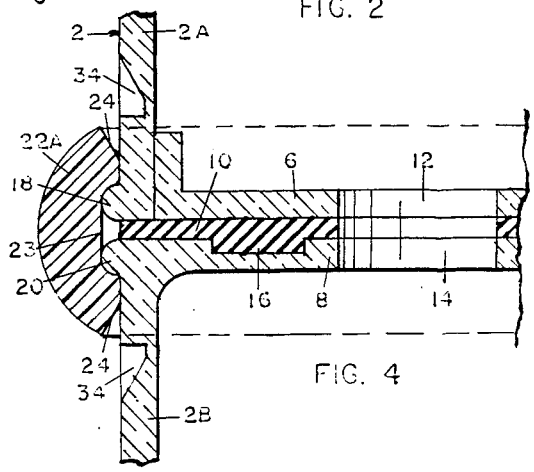
FIG. 4 is an enlarged view of a portion of FIG. 2, showing the locking means removed and the bottle sections turned to establish communication between a pair of adjacent bottle sections, and also showing a slightly modified assembly means.

FIG. 4 shows a slightly modified form of snap ring 22A, identical in all respects to the snap ring 22, except that its internal surface is provided with a single internal groove 23 which is wide enough to bridge both of the associated ribs 18 and 20. FIG. 5 shows an assembly means which, in place of the elastic snap ring 22 or 22A, utilizes a non-elastic sheet metal band 54 tightly surrounding the bottle at each juncture of adjacent bottle sections, each of said bands having its upper and lower edge portions rolled inwardly to engage the top of rib 18 and the bottom of rib 20, as indicated at 56 and 58, to hold the associated bottle sections in firm assembly. The edges of the metal band are of course rolled in after the bottle sections have been pressed axially together with enough force to compress sealing disc 10.

Each snap ring 22 or 22A, or metal band 54, is covered by a lock ring 26 shaped to conform to the outer surface of the snap ring or metal band, and being formed of a thin, easily tearable sheet metal. Said lock ring is applied under tension during the manufacture of the container, whereby to lock the snap ring firmly in place against dislodgment, even by rough handling. Each lock ring is provided with a tear strip 28 affixed thereto but having a loose end, which when pulled outwardly tears the lock ring along lines 30 thereof, which may be partially pre-cut, to free the lock ring from the container. The lock ring is provided, along both its upper and lower edges, with small tabs 32 which may be bent into engagement with small sockets 34 formed therefor in the outer surfaces of the associated bottle sections. Said sockets are so disposed that when tabs 32 are engaged therein, the associated bottle sections are disposed in the FIG. 3 position, with holes 12 and 14 out of registry.

The closure for neck 4 of the top bottle section 2A, as illustrated comprises an inner stopper 36 pressed snugly into the neck of the bottle and supported by an internal shoulder 38. It is formed of rubber or any other suitable material which may be pierced by a hypodermic needle, not shown. Said stopper is held in place by an internally threaded cap 40 threaded onto the neck, and having an aperture 42 formed through its top end wall. For sanitary purposes, the entire cap may be covered by a layer 44 of shrink-fitted plastic film or the like, said film extending downwardly around and sealed to the bottle below the cap.

In operation, when use of the container contents is desired, with the various ingredients properly intermixed, the user tears away the plastic cap cover 44, and then grasps the tear strip 28 of the lock ring 26 disposed between the bottle sections containing the two ingredients to be intermixed first. As shown, bottle section 2A contains a liqid 46, section 2B a powder 48, and section 2C a liquid 50. Of course, if the bottle has only two compartments, there will be only one lock ring, and only one intermixture. But where there are three or more compartments and ingredients, it may sometimes be preferred that two of the ingredients be thoroughly intermixed before the addition of a third ingredient, and so on. One example of such a condition commonly occurs when one of the ingredients is in powder form, which usually requires substantially more time to be thoroughly worked into a liquid than would the intermixture of two liquids. Therefore, in the illustrated example, it may be desired to tear away the lock ring 26 at the juncture of bottle sections 2B and 2C first, to provide for intermixture of powder 48 with liquid 50 before liquid 46 is added. The tearing away of either lock ring 26 of course frees its tabs 32 from sockets 34, whereupon the two associated bottle sections may be manually rotated relatively to each other about the axis of the bottle to bring the holes 12 and 14 of the adjacent end walls of said bottle sections into registry, thereby establishing communication between the bottle sections and permitting intermixture of their contents by the inversion and/or shaking of the entire container. When addition of the third ingredient to the mixture is desired, the other lock ring 26 is torn away, and the two bottle sections corresponding to said lock ring are manually rotated to establish communication therebetween. The only requirement for this type of two-stage mixing is that the two bottle compartments containing the ingredients to be mixed first are carried in successive compartments of the bottle. If extremely accurate parallelism between the mating surfaces of the end wall pairs 6 and 8 can be provided, an if said surfaces are sufficiently flat and smooth to prevent any flow of liquid between them when holes 12 and 14 are not in registry, then sealing disc 10 could be dispensed with.

Figure 1:
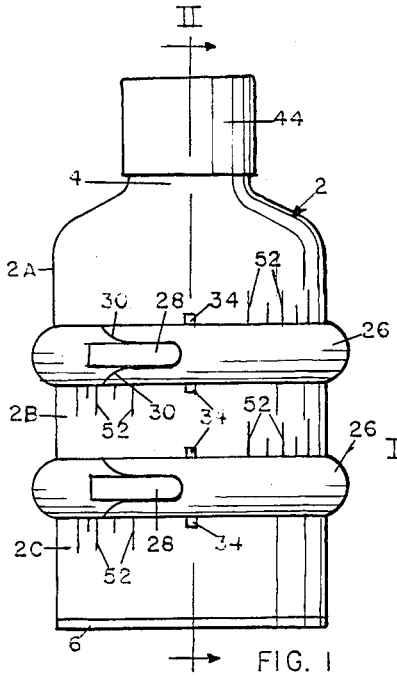
FIG. 1 is a side elevational view of a material mixing container embodying the present invention.
Figure 2:
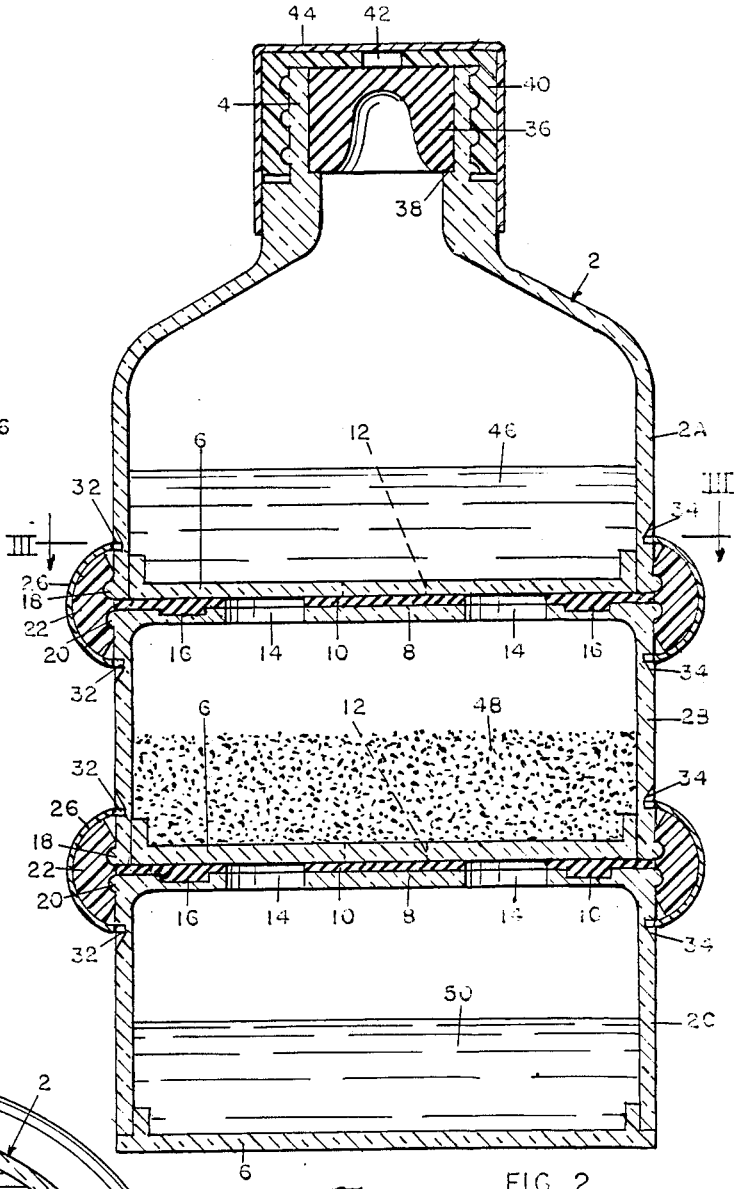
FIG. 2 is an enlarged sectional view taken on line II—II of FIG. 1.

The rate of intermixture of certain ingredients is also sometimes important, a slow rate often being indicated when mixing a liquid with a powder in order to avoid lumping of the powder. In the present device, this intermixture rate is controlled by means of indicia marks 52 imprinted on the outer surfaces of the bottle sections both above and below the juncture of each successive pair of bottle sections, as shown in FIG. 1. These indicia marks may be calibrated to indicate the extent to which holes 12 and 14 may have been moved into registry. That is, said holes may be moved to overlap only slightly in partial registry, or into any greater degree of overlapping. Since this determines the size of the passages interconnecting the related bottle sections, it also regulates the rate at which the contents of those sections are intermixed.

When the contents of all of the bottle sections are properly intermixed, the user may insert the needle of a hypodermic syringe through aperture 42 of cap 40, and through stopper 36, to withdraw the mixture for immediate use. Of course, if the mixture is not one requiring hypodermic administration, but is one which may simply be poured from the bottle, then stopper 36 may be eliminated, and a standard, nonapertured cap may be substituted for cap 40.

The present device also has the advantage that it is reusable any number of times, requiring only that new lock rings 26 be added to protect against accidental intermixture of the contents of the various sections, each time the container is cleaned and refilled.

While I have shown and described a specific embodiment of my invention, it will be readily apparet that many minor changes of structure and operation could be made without departing from the spirit of the invention.

What I claim as new and desire to protect by Letters Patent is:

1. A material mixing container comprising:

a. a bottle having an opening through which its contents may be removed, and having a partition dividing its interior into a pair of compartments each adapted to contain a different material, the materials contained in the compartments being intended for eventual intermixture with each other, b. a normally closed valve disposed in said partition to maintain said materials separated, c. operating means operable from externally of the container to open said valve to establish communication between said compartments, whereby said materials may be intermixed, d. said bottle comprising a pair of bottle sections which are generally cylindrical in form and disposed in end-to-end relation, and which are assembled to be relativly rotatable about the cylindrical axis, each of the bottle sections having a planar end wall at the end thereof adjoining the other bottle section, disposed normally to the cylindrical axis, said end walls forming said partition, and having apertures formed therethrough operable to be moved into or out of registry by the relative rotation of said end walls about the cylindrical axis, said apertured end walls, and the relative rotatability thereof, constituting said valve, e. a sealing disc of soft, compressible material disposed between said end walls, in contact with both, and f. assembly means joining said bottle sections firmly together but permitting manual relative rotation thereof about said cylindrical axis, and also being operable to urge said end walls toward each other to compress said sealing disc therebetween to provide an effective sealing against said end walls.

2. A container as recited in claim 1 wherein said sealing disc is provided with apertures disposed in coinciding registry with the apertures of one of said end walls, and with the addition of means preventing relative rotation between said sealing disc and said one end wall.

3. A material mixing container comprising:

a. a bottle having an opening through which its contents may be removed, and having a partition dividing its interior into a pair of compartments each adpted to contain a different material, the materials contained in the compartments being intended for eventual intermixture with each other, b. a normally closed valve disposed in said partition to maintain said materials separated, c. operating means operable from externally of the container to open said valve to establish communication between said compartments, whereby said materials may be intermixed, d. said bottle comprising a pair of bottle sections which are generally cylindrical in form and disposed in end-to-end relation, and which are assembled to be relatively rotatable about the cylindrical axis, each of the bottle sections having a planar end wall at the end thereof adjoining the other bottle section, disposed normally to the cylindrical axis, said end walls forming said partition, and having apertures formed therethrough operable to be moved into or out of registry by the relative rotation of said end walls about the cylindrical axis, said apertured end walls, and the relative rotatability thereof, constituting said valve, and e. assembly means joining said bottle sections firmly together, but allowing manual relative rotation thereof about said cylindrical axis, f. said assembly means comprising a snap ring of elastic material operable when tensioned to surround said bottle at the juncture of said bottle sections, said snap ring having a pair of spaced apart grooves formed in the surface thereof engaging said bottle and engaging a pair of peripheral ribs formed respectively on the two bottle sections.

4. A container as recited in claim 3 with the addition of a sealing disc of soft, compressible material interposed betweed said end walls, and wherein the grooves of said snap ring are so spaced apart that their engagement with said ribs causes compression of said sealing disc.

5. A material mixing container comprising:

a. a bottle having an opening through which its contents may be removed, and having a partititon dividing its interior into a pair of compartments each adapted to contain a different material, the materials contained in the compartments being intended for eventual intermixture with each other, b. a normally closed valve disposed in said partition to maintain said materials separated, c. operating means operable from externally of the container to open said valve to establish communication between said compartments, whereby said materials may be intermixed, d. said bottle comprising a pair of bottle sections which are generally cylindrical in form and disposed in end-to-end relation, and which are assembled to be relatively rotatable about the cylindrical axis, each of the bottle sections having a planar end wall at the end thereof adjoining the other bottle section, disposed normally to the cylindrical axis, said end walls forming said partition, and having apertures formed therethrough operable to be moved into or out of registry by the relative rotation of said end walls about the cylindrical axis, said apertured end walls, and the relative rotatability thereof, constituting said valve, and e. assembly means joining said bottle sections firmly together, but allowing manual relative rotation thereof about raid cylindrical axis, f. said assembly means comprising a snap ring of elastic material operable when tensioned to surround said bottle at the juncture of said bottle sections, said snap ring having a single peripheral groove formed in the surface thereof engaging said bottle, said groove being of sufficient width to bridge and engage both of a pair of peripheral ribs formed respectively on two bottle sections.

6. A container as recited in claim 5 with the addition of a sealing disc of soft, compressible material interposed between said end walls, and wherein the width of said groove of said snap ring is such that said snap ring maintains a compressive force on said sealing disc.

7. A material mixing container comprising:

a. a bottle having an opening through which its contents may be removed, and having a partition dividing its interior into a pair of compartments each adapted to contain a different material, the materials contained in the compartments being intended for eventual intermixture with each other, b. a normally closed valve disposed in said partition to maintain said materials separated, c. operating means operable from externally of the container to open said valve to establish conmmunication between said compartments, whereby said materials may be intermixed, d. said bottle comprising a pair of bottle sections which are generally cylindrical in form and disposed in end-to-end relation, and which are assembled to be relatively rotatable about the cylindrical axis, each of the bottle sections having a planar end wall at the end thereof adjoining the other bottle section, disposed normally to the cylindrical axis, said end walls forming said partition, and having apertures formed therethrough operable to be moved into or out of registry by the relative rotation of said end walls about the cylindrical axis, said apertured end walls, and the relative rotatability thereof, constituting said valve, and e. assembly means joining said bottle sections firmly together, but allowing manual relative rotation thereof about said cylindrical axis, f. said assembly means comprising a band of thin, non-elastic material surrounding said bottle at the juncture of said bottle sections, the longitudinal edges being shaped to bridge and engage the distal surfaces of a pair of pedripheral ribs formed respectively on the two bottle sections.

8. A material mixing container comprising:

a. a bottle having an opening through which its contents may be removed, and having a partition dividing its interior into a pair of compartments each adapted to contain a different material, the materials contained in the compartments being intended for eventual intermixture with each other, b. a normally closed valve disposed in said partition to maintain said materials separated, c. operating means operable from externally of the container to open said valve to establish communication between said compartments, whereby said nmaterials may be intermixed, d. said bottle comprising a pair of bottle sections which are generally cylindrical in form and disposed in end-to-end relation, and which are assembled to be relatively rotatable about the cylindrical axis, each of the bottle sections having a planar end wall at the end thereof adjoining the other bottle section, disposed normally to the cylindrical axis, said end walls forming said partition, and having apertures formed therethrough operable to be moved into or out of registry by the relative rotation of said end walls about the cylindrical axis, said apertured end walls, and the relative rotatability thereof, constituting said valve, and e. assembly means joining said bottle sections firmly together, but allowing manual relative rotation thereof about said cylindrical axis, and f. locking means operable to lock said bottle sections against relative rotation until it is released, said locking means comprising a band of inelastic material surrounding said bottle at the juncture of said bottle sections, said band having tabs along both of its longitudinal edges, said tabs being engaged in sockets formed therefor in the outer surfaces of the respective bottle sections, and means whereby said band may be manually torn to free it from said bottle to permit relative rotation of the bottle sections.

9. A container as recited in claim 3 with the addition of a band of easily torn but inelastic material surrounding said snap ring at the juncture of said bottle sections, said band having tabs along both of its longitudinal edges engaged in sockets formed therefor in the outer surfaces of the respective bottle sections to lock said bottle sections against relative rotation, said band also enclosing said snap ring to hold it in firm engagement with the rids of said bottle sections, and means whereby said band may be manually torn to free it from the bottle, wheredy to permit relative rotation of the bottle sections.

10. A container as recited in claim 1 wherein the bottle opening through which its contents may be removed is provided with a closure comprising:

a. a rubber stopper capable of being pierced by a hypodermic needle inserted snugly into said opening, and b. a rigid cap applied over said stopper and having an aperture overlying said stopper through which a hypodermic needle may be inserted.

* * * * *